US007175879B2

(12) United States Patent
Olry et al.

(10) Patent No.: US 7,175,879 B2
(45) Date of Patent: Feb. 13, 2007

(54) CARBONIZATION OF CELLULOSIC FIBROUS MATERIALS IN THE PRESENCE OF AN ORGANOSILICON COMPOUND

(75) Inventors: Pierre Olry, Bordeaux (FR); Sylvie Loison, Saint Medard En Jalles (FR); Mark Kazakov, Moscow (RU); Alentin Trouchnicov, Moscow (RU)

(73) Assignee: Snecma Propulsion Solide, Le Haillan (FR)

( * ) Notice: Subject to any disclaimer, the term of this patent is extended or adjusted under 35 U.S.C. 154(b) by 30 days.

(21) Appl. No.: 10/148,777

(22) PCT Filed: Dec. 5, 2000

(86) PCT No.: PCT/FR00/03388

§ 371 (c)(1),
(2), (4) Date: Jun. 4, 2002

(87) PCT Pub. No.: WO01/42541

PCT Pub. Date: Jun. 14, 2001

(65) Prior Publication Data

US 2002/0182138 A1 Dec. 5, 2002

(30) Foreign Application Priority Data

Dec. 6, 1999 (FR) ..... 99 15327

(51) Int. Cl.
*B05D 3/02* (2006.01)

(52) U.S. Cl. ..... 427/227; 427/228

(58) Field of Classification Search ..... 427/226, 427/227, 228, 229

See application file for complete search history.

(56) References Cited

U.S. PATENT DOCUMENTS 3,628,985 A * 12/1971 Hider et al. ..... 427/228
3,967,029 A * 6/1976 Veltri et al. ..... 428/216
4,080,417 A * 3/1978 Kishimoto et al. ..... 264/29.2
4,295,871 A * 10/1981 Droux et al. ..... 65/448
4,696,827 A * 9/1987 Okamura et al. ..... 427/551
5,074,912 A * 12/1991 Liles et al. ..... 106/2
5,587,345 A * 12/1996 Leung ..... 501/32
5,725,955 A * 3/1998 Tawil et al. ..... 428/408

FOREIGN PATENT DOCUMENTS

FR 1 307 291 A 2/1963
GB 1 130 304 A 10/1968
GB 1 222 881 A 2/1971

OTHER PUBLICATIONS

Database WPI: Section Ch, Week 199624, Derwent Publications Ltd., London, GB; Class A26, AN 1996-237811 (XP002136072); and RU 2 045 472 C (Kazakov, M.E.), Oct. 10, 1995, cited in the application abstract.

Database WPI: Section Ch, Week 199952, Derwent Publications Ltd., London, GB; Class A85, AN 1999-603671 (XP002136073); and JP 11 240779 A (Tokai Carbon KK), Sep. 7, 1999, abstract.

* cited by examiner

*Primary Examiner*—Fred J. Parker
(74) *Attorney, Agent, or Firm*—Weingarten, Schurgin, Gagenbin & Lebovici LLP

(57) ABSTRACT

The subject of the present invention is a method of obtaining fibrous carbon materials by carbonization of cellulosic fibrous materials carried out continuously or batchwise in the presence of at least one organosilicon compound. Characteristically, said organosilicon compound is chosen from the family of cyclic, linear or branched polyhydrosiloxanes which are substituted with methyl and/or phenyl groups and the number-average molecular mass of which is between 250 and 10 000, advantageously between 2 500 and 5 000.

8 Claims, No Drawings

CARBONIZATION OF CELLULOSIC FIBROUS MATERIALS IN THE PRESENCE OF AN ORGANOSILICON COMPOUND

The subject of the present invention is a method of carbonizing cellulosic fibrous materials in the presence of at least one organosilicon compound for the purpose of obtaining fibrous carbon materials. Said carbonization may be carried out both continuously and batchwise. The fibrous carbon materials obtained may then be heat treated (especially graphitized) in order to generate fibers having the desired properties.

Carbon fibers having a cellulosic precursor were the first carbon fibers manufactured in the world. Starting from such cellulosic precursors, Edison, at the end of the $19^{th}$ century, obtained filaments for his incandescent lamps (U.S. Pat. No. 223 898).

However, polyacrylonitrile has proved for a long time to be a more suitable precursor for obtaining high-strength high-modulus carbon fibers, more particularly those intended for the reinforcement of composites.

However, carbon fibers from viscose have been used since 1955 in the manufacture of carbon/phenolic resin composites employed as thermal protection for propulsion units. These low-modulus fibers have a restricted thermal conductivity. Manufacturing these fibers requires a particular rayon-type precursor: a rayon having a disoriented crystalline texture (R. Bacon, "Carbon Fibers from Rayon Precursors" in *Chemistry and Physics of Carbon,* 1973, Vol. 2, Marcel Dekker, New York and P. Olry, 14th Biennial Conference on Carbon, 1979).

More recently, it has proved possible to carbonize, with useful results, rayons of another type, especially highly oriented rayons, thanks to the intervention of an organic silicon derivative during carbonization.

Thus, continuous carbonization of unidirectional fabrics or webs of cellulose fibers has proved possible and resulted in carbon fabrics or carbon yarns, having a strength appreciably better than that of fabrics or yarns obtained by the conventional method (which comprises batchwise precarbonization followed by continuous carbonization), on condition that said fabric or said web be preimpregnated with a few percent of an organosilicon product. This has been described in particular in Russian patents RU 2045472 and 2047674.

Said organosilicon product was disclosed therein as an oligomer chosen from polydimethyl phenylallylsilanes, polysiloxanes, polymethylsiloxanes, polysilazanes and polyaluminoorganosiloxanes. In fact, its precise nature is not really specified.

Said patent RU 2047674 also discloses the advantage of making use, on the cellulosic substrates to be carbonized, apart from said organosilicon product, of a mineral additive called a "fire-retarding compound", such as $NH_4Cl$.

In this context, the novelty of the present invention lies in the selection of specific organosilicon compounds—additives for the carbonization of cellulosic fibrous materials—which are particularly effective. Said compounds have proven to be very efficient for improving the properties of the carbon fibers obtained from the carbonization, this being so with any type of carbonized cellulosic material (especially commercial staple fibers and rayons), whether said carbonization is carried out continuously or batchwise. Nevertheless, although the use of said compounds constitutes an undeniable benefit when carrying out carbonizations batchwise and continuously, it proves to be indispensable for the continuous carbonization of certain substrates (it makes said continuous carbonization of said substrates possible). The present invention therefore relates to the use of one particular family of organosilicon compounds within said context.

The subject of the present invention is in fact a method of obtaining fibrous carbon materials by carbonization of cellulosic fibrous materials carried out continuously or batchwise in the presence of at least one organosilicon compound. Characteristically, said organosilicon compound is chosen from the family of cyclic, linear or branched polyhydrosiloxanes, which are substituted with methyl and/or phenyl groups and the number-average molecular mass of which is between 250 and 10 000, advantageously between 2 500 and 5 000.

It is assumed that the increase in the strength of the filaments during carbonization in the presence of such additives, compared with that of filaments carbonized without an additive, is due to the bridging of the carbon chains during aromatization by said additives and/or their transformation products. This reinforcement of the carbon network takes place only at the surface of the fibers, but the reduction in surface defects which results therefrom causes a substantial increase in the strength of the filaments.

The magnitude of this reinforcement, with the additives of the invention, is remarkable. It makes it possible to counteract the shrinkage during carbonization and even to stretch the fibers (up to 50%) without them breaking, thereby ensuring orientation of the texture of said fibers and a reduction in or rearrangement of the internal pores. It has made it possible to obtain, with any type of cellulose (solvent celluloses and rayons, especially for tires), filaments which have strengths of around 1 500 to 2 000 MPa and moduli of around 70 to 110 GPa.

According to the invention, the family of additives used is that of polyhydrosiloxane oligomers (oligomers, because of their number-average molecular mass, of between 250 and 10 000, generally between 250 and 7 000, advantageously between 2 500 and 5 000). Such oligomers:

- owing to their molecular mass and the presence of methyl and/or phenyl groups in their chemical structure, have suitable thermal stability (optimized with respect to that of cellulose, i.e. they are stable up to the degradation temperature of cellulose and capable of reacting with the degradation products of said cellulose at the degradation temperature of the latter) and a viscosity compatible with their use;
- owing to the presence of —SiH reactive functional groups in their chemical structure, are capable of reacting via hydrosilylation reactions with the cellulose degradation products, within which products double bonds are formed.

The subject matter developed in the above paragraph, which seems very logically to explain the very good results obtained with the additives of this family, was obviously developed a posteriori.

Polyhydrosiloxanes of said family are commercially available at the present time. Certain polyhydrosiloxanes are for example sold by Rhodia Silicones.

Advantageously, these polyhydrosiloxanes are used prior to carbonization, the fibrous cellulosic materials being preimpregnated with them. To carry out such an impregnation, said polyhydrosiloxanes are generally used dissolved in a solvent, such as perchloroethylene. Such a solvent can easily be removed before carbonization.

It may be pointed out here, in general, that said polyhydrosiloxanes selected according to the invention are used, of course, in an effective amount, generally from 1 to 10% by weight, with respect to the weight of cellulosic materials. They have to be used in sufficient quantity to observe the expected effect, but not in excessive quantity as then an inopportune bonding effect may be observed. A person skilled in the art is able to optimize the amount of organosilicon compounds to be used, the use of which is recommended within the context of the method of the invention.

The inventors have also noted that the beneficial effect of said organosilicon compounds could be further enhanced by the combined use of a mineral additive.

According to a preferred variant for implementing the method of the invention, the cellulosic fibrous materials are thus also impregnated, before they are carbonized, with at least one mineral additive, a Lewis acid or base.

Said mineral additive may especially be chosen from ammonium and sodium halides, sulfates and phosphates, urea and mixtures thereof.

Advantageously, it consists of ammonium chloride ($NH_4Cl$) or diammonium phosphate [$(NH_4)_2HPO_4$].

The method may also involve two successive impregnations of the cellulosic fibrous material to be carbonized (one with an organosilicon compound and the other with a mineral additive, in any order).

When such a mineral additive is used, it is possible to obtain very promising results, especially high strengths in the case of carbon fibers and to do so with a better carbon yield (from 25 to 30%) than that obtained without said additive (from 15 to 20%).

As already indicated, the additives of the invention are advantageously used, both in carbonization processes carried out batchwise and in carbonization processes carried out continuously. It has been seen that they make it possible to carry out certain carbonizations continuously (which carbonizations were, according to the prior art, only possible to carry out batchwise).

According to a preferred implementation variant, the method of the invention is thus carried out continuously.

Finally, it will be recalled that the method of the invention—carbonization of cellulosic fibrous materials in the presence of specific organosilicon compounds—is particularly beneficial in that it allows effective carbonization, batchwise and continuously, of any type of cellulose, packaged in various forms.

The cellulosic fibrous material may especially be in the form of textile yarns or surfaces (wovens, knits, felts, nonwovens, unidirectional webs, unidirectional tapes, . . . ).

Said cellulosic fibrous material may especially consist of any type of rayon or staple fiber. The method of the invention is, in this case, particularly beneficial: it results, used with products widely available on the market, in high-quality fibrous carbon materials. According to the prior art, such high-quality materials could be obtained only from cellulosic fibrous materials of a very particular type.

It is therefore recommended to implement the method of the invention—the use of the organosilicon compounds described above—in the carbonization of such cellulosic substrates, widely available on the market, such as the rayons intended hitherto for reinforcing tires.

Of course, the field of application of said method is not limited to the carbonization of these substrates . . .

The invention will now be illustrated by the examples below.

EXAMPLE 1

A 3 680 dtex high-tenacity cellulose yarn (super 3 type), having a strength of 50 cN/tex (12.7 μm filament diameter), was desized by perchloroethylene then impregnated with 2.5% by weight of a polyhydrophenylmethylsiloxane having a viscosity of 10 Pa·s, containing 90% —$Si(CH_3)_2$—groups, 5% —$Si(CH_3)$ ($C_6H_5$)— groups and 5% —$Si(CH_3)H$— groups in addition to —$Si(CH_3)_2H$ of the chain ends, having a number-average molecular mass of 3 850, by passing it through a 3 wt % solution of this polyhydrosiloxane in perchloroethylene. After removing the perchloro-ethylene, the cellulose yarn was pyrolyzed in static mode, at up to 1 200° C., so as to shrink freely according to the thermal profile below:

at 170° C., for 90 min, in air;

in succession: 230° C., 285° C., 315° C., 330° C., 400° C., 485° C., 555° C. and 655° C., for 5 min at each of these temperatures, in nitrogen;

at 1 200° C., for 2.5 min, in nitrogen.

This pyrolysis, carried out batchwise within the context of the example, could just as well have been carried out continuously.

The carbon filaments extracted from the carbonized yarn had a tensile strength of 1 125 MPa and a modulus of 40 GPa for a diameter of 5.8 μm. The carbonization shrinkage along the axis of the fibers was 40%.

The carbonization yield was 15.6%.

EXAMPLE 2

A cellulose yarn identical to that of example 1 was desized with perchloroethylene, then impregnated with 2.5 wt % of a polyhydromethylsyloxane resin sold by Rhodia Silicones (with the reference: RHODORSIL RTV 141 B) by dipping it in a 3 wt % solution of the product in perchloroethylene. The pyrolosis was carried out, with free shrinkage, according to the thermal profile of example 1.

The carbon filaments extracted from the yarn had a tensile strength of 1 100 MPa, a modulus of 40 GPa and a diameter of 5.7 μm. The carbonization shrinkage along the axis of the fibers was 40%.

The carbonization yield was 15.2%

EXAMPLE 3

A cellulose yarn identical to that of example 1 was desized and then impregnated with the organosilicon additive as in example 1. It was then impregnated with 8% by weight of $NH_4Cl$ by passing it through a 13 wt % aqueous solution of said $NH_4Cl$.

The yarn was dried at 100° C. for 30 min and the excess $NH_4Cl$ was removed by rinsing for a few seconds in distilled water.

Said yarn was dried at 100° C. for 1 hour and then underwent pyrolysis at 1 200° C. as in example 1.

The tensile strength of the carbon filaments extracted from said carbonized yarn was 1 200 MPa and their modulus was 45 GPa, for a diameter of 8.3 μm. The shrinkage during carbonization was 32.3%.

The carbonization yield was 30%.

EXAMPLE 4 (COMPARATIVE EXAMPLE)

A cellulose yarn identical to that of example 1 was desized with perchloroethylene and then, without being impregnated with the polyhydrosiloxane additive, it was pyrolyzed according to the thermal profile indicated in said example 1.

The tensile strength of the carbon filaments extracted from the yarns obtained was only 660 MPa and their modulus was 38 GPa. The diameter of said filaments was 5.8 μm.

The invention claimed is:

1. A method comprising continuously or batchwise obtaining reinforced fibrous carbon materials by carbonization of cellulosic fibrous materials in the presence of at least one organosilicon compound, wherein said organosilicon compound is chosen from a family of cyclic, linear or branched polyhydrosiloxanes substituted with methyl and/or phenyl groups and having a number-average molecular mass of between 250 and 10,000;

subjecting said cellulosic fibrous materials to said carbonization causing reaction with said at least one organosilicon compound so as to provide said reinforced fibrous carbon materials.

2. The method of claim 1, wherein said cellulosic fibrous materials are impregnated with said organosilicon compound prior to said carbonization.

3. The method of claim 1, wherein said cellulosic fibrous materials are impregnated with at least one mineral additive, a Lewis acid or base prior to said carbonization.

4. The method of claim 3, wherein said mineral additive is chosen from ammonium halides, sodium halides, sulfates, phosphates, urea or mixtures thereof, or consists of ammonium chloride or diammonium phosphate.

5. The method of claim 1, wherein said carbonization is carried out continuously.

6. The method of claim 1, wherein said carbonization is carried out batchwise.

7. The method of claim 1, wherein said cellulosic fibrous materials consist of textile yarns or surfaces comprising wovens, knits, felts, nonwovens, unidirectional webs or unidirectional tapes.

8. The method of claim 1, wherein said cellulosic fibrous materials are rayons suitable for reinforcing tires.

* * * * *